United States Patent [19]

Gould

[11] 4,254,575

[45] Mar. 10, 1981

[54] ILLUMINATED FLYING SAUCER-LIKE TOYS

[76] Inventor: Arnold S. Gould, 17 Oakland St., Lexington, Mass. 02173

[21] Appl. No.: 11,550

[22] Filed: Feb. 12, 1979

Related U.S. Application Data

[63] Continuation of Ser. No. 803,222, Jun. 3, 1977, abandoned.

[51] Int. Cl.[3] ..... A63H 27/00

[52] U.S. Cl. ..... 46/74 D; 273/424

[58] Field of Search ..... 46/74 D, 220, 228, 49; 273/106 B, 102.1 C, DIG. 24; 362/34

[56] References Cited

U.S. PATENT DOCUMENTS

| | | | |
|---|---|---|---|
| 2,809,833 | 10/1957 | Slade | 46/49 X |
| 2,979,860 | 4/1961 | Barta | 46/220 |
| 3,597,362 | 8/1971 | Bollyky et al. | 252/166 |
| 3,786,246 | 1/1974 | Johnson et al. | 46/74 D X |
| 3,875,602 | 4/1975 | Miron | 362/34 X |
| 4,061,910 | 12/1977 | Rosenfeld | 362/34 |
| 4,086,723 | 5/1978 | Strawick | 46/74 D |

*Primary Examiner*—Gene Mancene
*Assistant Examiner*—Mickey Yu

[57] ABSTRACT

A system of illuminating flying saucer-type toys for use at night or when visibility is poor by chemiluminescence. The invention includes a system for such illumination by the insertion of a hoop-shaped device to the underside of the toy. The hoop-shape is formed from a flexible rod-like device containing chemiluminescent materials.

8 Claims, 6 Drawing Figures

ILLUMINATED FLYING SAUCER-LIKE TOYS

This is a continuation of application Ser. No. 803,222 filed June 3, 1977 now abandoned.

BACKGROUND OF THE INVENTION AND PRIOR ART

Flying saucer-like toys with various aerodynamic design features have been familiar for use in throwing games for at least 10 years (see U.S. Pat. No. 3,359,678).

Up to now these flying saucer toys could be used in the dark or in poor light only with difficulty or inconvenience. Such toys have been made with phosphorescent plastic material but using them requires some external light source for excitation. The light produced is of low intensity. The light produced lasts at a useable level for only a few minutes between excitations, and the evenly lighted shape is difficult to perceive in depth and so is hard to catch.

Inexpensive chemi-luminescent compositions have been known for some years (see U.S. Pat. No. 3,597,362) which produce bright light lasting for hours. These compositions can be stored in parts which are stable for long periods and the composition can be activated subsequently by mixing the parts. In the past, this has been done by storing one part of the composition in an outer, flexible, light transmitting tube means and by storing another part of the composition in an inner, rigid, breakable tube means (see U.S. Pat. No. 3,576,987), so that the composition can be easily activated by breaking the inner tube means.

SUMMARY OF THE INVENTION

This invention provides an illuminated flying saucer toy for use at night without the need for an external light source to excite phosphorescence. This invention provides a more brightly lighted toy than has been available with a long-lasting light source for the saucer toy and provides lighting for the toy which makes its shape more easily perceived, so that it can be more easily caught. The invention does not interfere with the aerodynamic qualities of the flying saucer toy but can improve them. The invention provides means to light the toy inexpensively with a device which is easily activated and which can be stored for long periods before activation. The invention is easily inserted into the toy or removed from it but remains secure thereby during vigorous use. The invention is a lighting device which is non-hazard us both during use and after disposal. This invention applies the art of chemicaluminescence in hoop form.

DETAILED DESCRIPTION AND OPERATION OF THE INVENTION

A chemiluminescent composition's parts are contained in the inner and outer tube means. When activated the chemiluminescent composition provides bright light for up to several hours and dimmer light subsequently for a total use time of up to 10-12 hours or more depending on composition and conditions. Suitable compositions are described in U.S. Pat. No. 3,597,362. The bright light is substantially brighter than that provided by the phosphorescent material currently used to provide lighted flying saucer toys.

Figure 1:
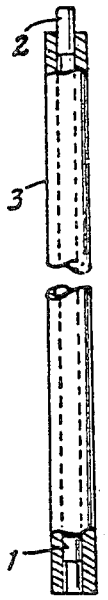
FIG. 1 is a plan view in partial cross-section of one element of the present invention.

FIG. 1 shows the outer tube means 3. It is made from material which is light transmitting at temperatures ranging from below 0° F. to over 130° F. The material contains one part of a chemiluminescent composition which is stable for a period of 1 year or more. The material is flexible at temperatures ranging from below 0° F. to over 130° F. The material is tough enough and the outer tube means 3 has walls thick enough so that the outer tube means 3 can withstand ordinary vigorous use and such expected hazards as high impact and dog biting without rupturing. The coefficient of thermal expansion and other expansions coefficients of the material are similar to those of the flying saucer toy's material. An example of a material with all these characteristics is polyethylene which also resists corrosion by the chemiluminescent compositions. The outer tube means 3 is closed and sealed with two plugs 1 and 2. Plug 1 is completely inserted into one end of the outer tube means 3 far enough to provide a recess. Plug 2 is partially inserted into the other end of the outer tube means 3, so that plug 2 is secure, but so that a portion of it protrudes. The length of the outer tube means 3 is such that when it is bent into a hoop shape, the hoop will fit tightly into the middles of the inner rim 7 of a flying saucer toy 6.

Figure 2:
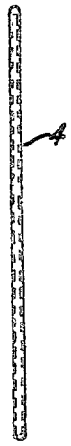
FIG. 2 is a plan view of another element of this invention.

FIG. 2 shows the inner tube means 4. It contains the other part of a chemiluminescent composition which is stable for a period of one year or more. The inner tube means 4 is sealed but breakable and can be made of some light transmitting rigid, brittle material such as glass. The inner tube means 4 has a small enough diameter to fit easily into the outer tube means 3. The inner tube means 4 is long enough so that when the outer tube means 3 is bent into a hoop shape the inner tube means 4 breaks at multiple spots, readily mixing the parts of the chemiluminescent composition.

Figure 3:
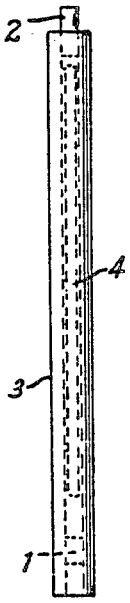
FIG. 3 is a plan view of the assembled elements.

FIG. 3 shows the assembled device ready for use. The inner tube means 4 is contained within the outer tube means 3 which is closed and sealed by recessed plug 1 and protruding plug 2. The user activates the device by bending the flexible outer tube means 3 into a hoop shape. This breaks the inner tube means 4, quickly mixing the parts of the chemiluminescent composition and activating it immediately. The user inserts the protrusion of plug 2 into the recess near plug 1, creating male/female closure 5 which joins the device into hoop shape. The user then inserts the activated hoop shaped device into the under side of the flying saucer toy against the inner rim.

Figure 4:
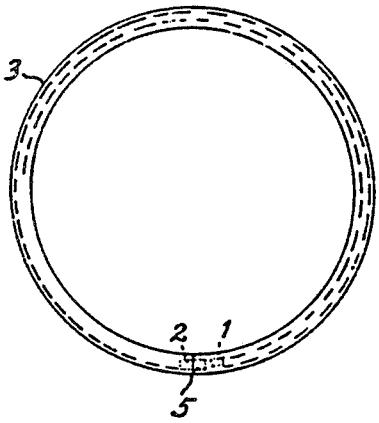
FIG. 4 is a plan view of the present invention formed into a hoop with the chemiluscent materials thereby activated.

The activated hoop form of the insert is shown in FIG. 4.

Figure 5:
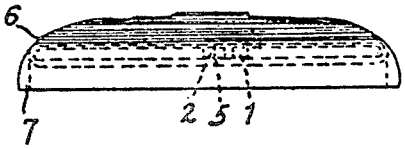
FIG. 5 is a side elevation view of a toy with the hoop of FIG. 4 inserted.
Figure 6:
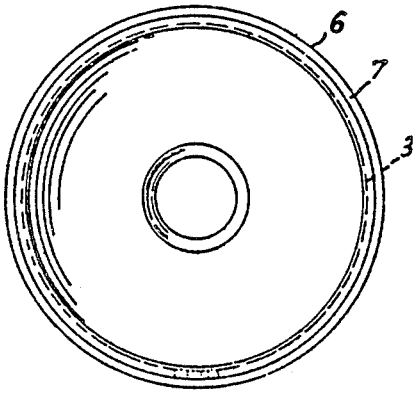
FIG. 6 is a bottom plan view of FIG. 5.

The flying saucer toy with the device inserted is shown in top view, FIG. 6 and side view, FIG. 5. The bottom of the inner edge of the rim 7 of the flying saucer toy 6 is typically of slightly lesser diameter than the middle of the inner edge of the rim 7. This provides a lip which, together with the tight fit of the hoop shaped device and resilience of the outer tube secures it in place during even vigorous shape, and because of the compression of the flexible outer tube means, use and impact subject the male/female closure 5 to forces which can only compress the closure 5 more tightly.

The additional weight and structure which the device adds to the flying saucer toy do not affect its aerodynamic properties negatively. In fact the device improves models with lighter cheaper rims 7, making them easier to throw with greater distance and accuracy.

The device provides a hoop shape of light for the flying saucer toy. Unexpectedly, this makes the toy easy to locate, to time, and to catch, apparently because the binocular vision of the user together with the separation of light bands on the front and rear of the toy as well as the sides enables the user to have a depth perception of the toy. Current fluorescent models provide a disk shape of light which is difficult to perceive and to catch.

The device can be made inexpensively. Consequently even though one period of use exhausts and consumes the toy, it is economically practical.

While only one hoop is illustratively inserted into the under side of the toy, it will be apparent that one or more hoops, depending upon the tube size, could be inserted. The illuminating device could have a different form or be of smaller diameter than illustrated providing adequate measure employed to secure the device to the toy so as to be able to withstand the shocks of striking objects without falling free of the toy.

Also it will be apparent that the inner tube means could be of various lengths, and there could be a plurality of such within the outer tube either of a single color or different colors.

What is claimed is:

1. An aerodynamic toy comprising,
a saucer-shaped translucent body of predetermined circumferential length,
said body having a rim at the periphery thereof defining an annular cavity, and
a flexible tubular member containing chemical means for producing light bent into a ring and inserted in said cavity,
said tubular member being resilient and having a predetermined diameter and a length corresponding to said circumferential length such that said ring fits tightly within said cavity.

2. The toy of claim 1 wherein,
the light producing means of said ring extends substantially entirely around said annular cavity,
whereby there is a continuous band of light around the periphery of said saucer.

3. The toy of claim 2 wherein,
said body and tubular member are circular in plan.

4. The toy of claim 1 wherein said tubular member further comprises,
a flexible tube containing a first chemiluminescent component, and
a brittle tube fixed within said flexible tube containing a second chemiluminescent component,
whereby when said tubular member is bent into a ring, said fixed brittle tube will fracture causing said chemiluminescent components to mix and provide a ring of light.

5. The toy of claim 1 wherein said tubular member further comprises,
a plug extending from one end thereof, and
a recess at the other end thereof adapted to receive said plug to close said ring,
whereby impact forces applied to said body cause compressive forces within said ring tending to push said plug into said recess to hold said ring closed.

6. The toy of claim 5 wherein said tubular member further comprises,
a plurality of brittle tubes fixed within said flexible tube, each said brittle tube containing a chemiluminescent component.

7. The toy of claim 6 wherein,
said brittle tubes contain a plurality of different color chemiluminescent components.

8. The toy of claim 1 wherein,
said rim extends inwardly of said body.

* * * * *

UNITED STATES PATENT AND TRADEMARK OFFICE

CERTIFICATE OF CORRECTION

PATENT NO. : 4,254,575

DATED : March 10, 1981

INVENTOR(S) : Arnold S. Gould

It is certified that error appears in the above-identified patent and that said Letters Patent are hereby corrected as shown below:

Column 4, line 33, "claim 5" is changed to --claim 4--.

Signed and Sealed this

Ninth Day of June 1981

[SEAL]

*Attest:*

RENE D. TEGTMEYER

*Attesting Officer*

*Acting Commissioner of Patents and Trademarks*